US009975615B2

(12) United States Patent
Baron

(10) Patent No.: US 9,975,615 B2
(45) Date of Patent: May 22, 2018

(54) DEVICE FOR MARINE EXPLORATION

(71) Applicants: Guy Baron, Nouméa Nouvelle-Calédonie (FR); Sophie Baron, Paris (FR); Cécile Baron, Marseilles (FR); Georges-Henri Baron, Toulouse (FR); Marie-Françoise Baron, Nouméa Nouvelle-Calédonie (FR)

(72) Inventor: Guy Baron, Nouvelle-Calédonie (MC)

(73) Assignees: Sophie Baron, Paris (FR); Cécile Baron, Marseille (FR); Guy Baron, Nouvelle-Calédonie (FR); Marie-Françoise Baron, Nouméa Nouvelle-Calédonie (FR); Georges-Henri Baron, Toulouse (FR)

( * ) Notice: Subject to any disclaimer, the term of this patent is extended or adjusted under 35 U.S.C. 154(b) by 37 days.

(21) Appl. No.: 14/443,958

(22) Filed: May 19, 2015

(65) Prior Publication Data

US 2015/0284063 A1 Oct. 8, 2015

(30) Foreign Application Priority Data

Nov. 23, 2012 (FR) ..... 12 61190

(51) Int. Cl.

| | |
|---|---|
| ***B63C 11/46*** | (2006.01) |
| ***B63B 35/607*** | (2006.01) |
| ***B63B 35/73*** | (2006.01) |
| ***B63B 1/04*** | (2006.01) |
| ***B63B 1/12*** | (2006.01) |
| ***B63B 7/08*** | (2006.01) |

(Continued)

(52) U.S. Cl.

CPC ..... *B63C 11/46* (2013.01); *B63B 1/04* (2013.01); *B63B 1/121* (2013.01); *B63B 7/08* (2013.01); *B63B 35/607* (2013.01); *B63B 35/73* (2013.01); *B63B 59/00* (2013.01); *B63H 5/15* (2013.01); *B63H 20/12* (2013.01); *B63H 21/12* (2013.01)

(58) Field of Classification Search

CPC ..... B63C 11/46
USPC ..... 114/66
See application file for complete search history.

(56) References Cited

U.S. PATENT DOCUMENTS 3,160,133 A * 12/1964 Walker ..... A63H 23/00 114/245
3,400,680 A 9/1968 Taylor
(Continued)

FOREIGN PATENT DOCUMENTS

AU 2007234478 A1 6/2009

OTHER PUBLICATIONS

International Search Report Application No. PCT/FR2013/052849 report dated Jul. 7, 2014.

*Primary Examiner* — Lars A Olson
*Assistant Examiner* — Jovon Hayes
(74) *Attorney, Agent, or Firm* — Miller, Matthias & Hull LLP

(57) ABSTRACT

The invention relates to a device for the exploration of the ocean space, intended to be fixed to a boat, the exploration device comprising a support that is able to receive one or more users in a lying position, a deployment means, said deployment means making it possible to position the support in a given position under the water such that, when the support is in said given position under the water, said one or more users can lie down on the support, being partially (Continued)

immersed, and fixing means for maintaining the support in the given position under the water.

30 Claims, 14 Drawing Sheets

(51) Int. Cl.

| | |
|---|---|
| ***B63B 59/00*** | (2006.01) |
| ***B63H 5/15*** | (2006.01) |
| ***B63H 20/12*** | (2006.01) |
| ***B63H 21/12*** | (2006.01) |

(56) References Cited

U.S. PATENT DOCUMENTS 3,688,720 A * 9/1972 Henderikus ..... B63C 11/42 114/333
4,276,851 A * 7/1981 Coleman ..... B63B 1/121 114/313
4,840,592 A * 6/1989 Anderson ..... B63C 11/49 114/66
4,928,614 A * 5/1990 Forman ..... B63B 3/13 114/314
4,946,412 A * 8/1990 Maruo ..... A63B 31/00 114/66
5,362,269 A * 11/1994 Leach ..... B63B 35/73 114/144 R
5,595,133 A * 1/1997 Bullard ..... B63C 11/49 114/66
6,805,064 B1 * 10/2004 Andersen ..... B63C 11/46 114/66
2004/0154523 A1 * 8/2004 Arias ..... B63B 7/08 114/343
2014/0193206 A1 * 7/2014 Montousse ..... B63C 11/46 405/185
2015/0284063 A1 * 10/2015 Baron ..... B63B 35/607 114/61.1

* cited by examiner

DEVICE FOR MARINE EXPLORATION

CROSS-REFERENCE TO RELATED APPLICATION

This Application is a 35 USC § 371 US National Stage filing of International Application No. PCT/FR2013/052849 filed on Nov. 25, 2013, and claims priority under the Paris Convention to French Patent Application No. FR 12 61190 filed on Nov. 23, 2012.

FIELD OF THE DISCLOSURE

The present invention relates to a device for exploring the ocean space, intended to be attached to a vessel to allow surface immersion of swimmers equipped with breathing means, in comfort and autonomy.

BACKGROUND OF THE DISCLOSURE

There are numerous marine vehicles for moving about underwater at shallow depths, making use of fins, pedal-driven propellers, etc. for human propulsion, or electric motors, combustion engines, etc. for motorized propulsion, or towing.

To move about underwater at greater depths, a watercraft is known from the prior art that is the object of patent application FR 2 951 134. This device and its variations have the following main features:

- When the watercraft is submerged, the submerged structure is at least 1.5 meters underwater, requiring the use of breathing apparatus (SCUBA);
- The speed when the watercraft is out of the water is limited to 12 knots;
- The autonomy of the watercraft when underwater is limited because of the need for a breathing apparatus (SCUBA);
- The construction costs;
- The size of the craft.

Also known from the prior art is a watercraft for exploring the seabed that is the object of patent application AU2007 234478. This document relates to a pleasure craft comprising a submersible support and a mechanism for raising and lowering the support. The mechanism as described is a rotating-arm system and the support can therefore be submerged in the water or raised out of the water by deployment of the rotating arms. This device, including the submersible support and mechanism, is incorporated into the vessel. Such a device makes the vessel quite cumbersome when in storage. In addition, such an exploration watercraft must be equipped with a suitable exploration device that is integrated with it. In addition, this watercraft is particularly suitable for diving with air tanks; this type of diving is not suitable for everyone and requires long preparation for the user.

There is therefore a need for systems for surface exploration with fins and snorkel, also called snorkeling, for inexperienced divers in particular.

The present invention is proposed to overcome some of the disadvantages of the prior art.

SUMMARY OF THE DISCLOSURE

In a first aspect, the invention relates to a device for exploring the ocean space, intended to be attached to a vessel, the exploration device comprising:

- a support able to receive one or more users in a recumbent position

- deployment means, said deployment means enabling the positioning of the support in a given position under the water, such that when the support is in said given position under the water said one or more users can lie on the support while being partially immersed
- securing means for maintaining the support in the given position under the water.

It will become apparent in the following description that certain embodiments of the invention provide numerous advantages.

With such a device, it is possible to snorkel without any training. Those who cannot dive very far for medical reasons will be able to explore the seabed. This device also has the advantage of freeing the user's hands so that he or she can collect samples or take photos or movies for example. The use of such a device protects the diver from the ocean due to the support that is carrying him or her. In addition, the support is pulled by the vessel to which it is attached. The user is therefore pulled along and carried by the support which serves as a means of transportation. The device therefore does not require physical effort for moving about at the desired direction and speed. When the device is not deployed, phases of fast cruising are possible in order to travel to the location to be explored for example, and its deployment then allows phases of underwater exploration in front of and below the craft, especially in shallow waters, from the craft.

In preferred embodiments of the device for exploring the ocean space according to the invention, one or more of the following arrangements may be used:

- it is attached to a vessel partially submerged in water and partially above the water, and when said exploration device is mounted on said vessel on the water and when said support is in said given position under the water, said deployment means is partially immersed and partially above water, said support is at least partially immersed, and the device is therefore immersed to a depth in said given position under the water, said immersion depth being determined by the geometric characteristics of the deployment means, said depth being about the thickness of a human being.

the proximity of the vessel provides an additional means of protection to the user against any predators encountered during exploration.

- the deployment means allows moving the support between a position out of the water and the given position under the water, deployment is fast and easy.

- the securing means allow maintaining the support in the given position out of the water.
- the deployment means is suitable for mounting on the port side and starboard side of the vessel.
- said deployment means is suitable for mounting at the bow of the vessel.
- said deployment means comprises at least two bars, said bars being intended to be arranged respectively on the port and starboard sides of the vessel and to maintain the support in the given position.
- the bars of the deployment means are connected by two crossbars to form a closed frame.
- the bars of the deployment means are connected by a crossbar to form a U-shaped frame.
- the deployment means comprises a guiding system, said guiding system being formed by at least two bearings, or two hasps, intended to be arranged respectively on the port and starboard sides of the vessel to allow deployment by rotating the bars into the given position under the water.

the support in the given position is intended to be arranged under, in front of, or between the submerged portions of the vessel.

the deployment means is intended to be mounted at least either to port or starboard on the lateral faces of the vessel and comprises at least two structures located on the same lateral face of the vessel respectively at the front and back of the boat, said structures forming a frame to which the support is secured in the given position under the water.

each structure comprises four sections such that, when the vessel is on water, a first section is parallel to the surface of the vessel and attaches the structure to said vessel, a second section is perpendicular to the third section and is of a length such that the lower end is partially immersed, a third section is parallel to the surface of the water and immersed and is connected to the support, and a fourth section is parallel to the second section and is at least partially immersed.

the support comprises at least one elongated float attached between the second sections of the structures and comprises at least one elongated float attached between the fourth sections of structures.

the structure can be folded onto itself, the deployment means comprising a guiding system for this, said structure being pivoted at the guiding system then raised to a position alongside and parallel to the lateral face of the vessel at the height of the guiding point of the structure.

the securing means are front and rear means wherein the front securing means secure a front end of the support to the deployment means and the rear securing means stabilize the support in a plane substantially parallel to the surface of the water, when said one or more users is (are) lying on the support, being adapted to connect a rear end of the support located opposite the front end to a portion of the vessel located between the front portion and the stern of the vessel.

the support comprises a flexible sheet that is sufficiently large to accommodate a recumbent user, such as a trampoline, a net, or a technical textile, the support optionally further comprising one or more stiffening slats.

it comprises at least two securing means for securing to a vessel, said means being spaced apart by a certain gap, and a dimension of the gap is adjustable.

the support comprises a cradle, said cradle having a structure, said device being attached to a vessel, said vessel comprising at least one lateral hull, said hull having an inner sidewall facing the cradle structure.

Partial immersion or surface access to the water is immediate, the exploration device being deployed in seconds and not needing to travel much distance from a non-immersed position to its immersed position; a lot of time spent lowering and raising is saved by shortening the distance to the water, because it is always at the surface or partially immersed.

the deployment means of the device is a means for performing a pivoting movement, said cradle pivoting about a shaft, said shaft transfixing the rear end of the cradle, said shaft being sealingly attached to the cradle, said shaft being symmetrically and sealingly attached to the rear portions of the hulls of said vessel, the deployment means comprising a guiding system, said shaft constituting said guiding system.

the deployment means is a hoist, said hoist being connected to the center of the front beam, said hoist being adapted to support the front portion of the cradle, actuation of said hoist lowering said front portion of the cradle so as to position the cradle in said given position under the water.

the cradle has flanges on its outer sides, which are unmoving relative to the body of the cradle, said flanges being adapted to stabilize the cradle in the given position out of the water.

the deployment means allows moving the support between a position out of the water and the given position under the water, the securing means maintaining the support in the given position under the water.

it further comprises one or more of the following arrangements:

a control means for the vessel which allows remote control of its running a control means for stopping a control means for steering the craft, the control means possibly being gimbal-mounted or connected to the vessel by a flexible cable, the vessel is equipped with an emergency stop control its propeller(s) is/are equipped with propeller protection.

In other preferred embodiments of the invention, the following may possibly be additionally used:

a system comprising a semi-rigid vessel and a device for exploring the ocean space equipping this vessel.

a system comprising an inflatable vessel and a device for exploring the ocean space equipping this vessel.

a system comprising a monohull vessel and a device for exploring the ocean space equipping this vessel.

a system comprising a catamaran and a device for exploring the ocean space equipping this catamaran.

a system comprising a vessel comprising a floating body and a device, wherein the device is assembled to the floating body.

a system wherein, in the given position under the water, the floating body and the support define a protective space.

a system wherein another floating body of the vessel or the deployment means defines an additional boundary of the protective space.

a vessel adapted to receive a device, wherein the vessel is motorized.

According to a supplementary aspect of the device for exploring the ocean space, which is independent of the deployable device, a lightweight kit is also proposed, particularly one advantageous for snorkeling in a protected situation but without requiring a heavy boat to deploy it. A device for exploring the ocean space is proposed that comprises two floats, at least one structure (for example a front structure and a rear structure), said structure being adapted to maintain a constant gap between said two floats. The lightweight kit comprises two flexible assembly portions, each adapted to surround a respective float, and the support extending in a slightly immersed manner between the two assembly portions. The floats are surrounded for example by sliding them into place. For example, said structures comprise loops at their ends, said loops being suitable for sliding said floats within them, and a support, said support also comprising loops on each side, said loops being suitable for sliding said floats within them. The structure may for example support the propulsion system (engine, propeller, fuel tank, etc.).

With such an arrangement, the lightweight kit can be quickly assembled and disassembled, for example for easy transport by car when disassembled.

Additional features of this first additional aspect are provided below in the detailed description.

BRIEF DESCRIPTION OF THE DRAWINGS

FIG. 13 *a, b, c*: Cross-sections of the view of FIG. 13;

FIG. 14 *a, b, c*: Cross-sections of the view of FIG. 14;

DETAILED DESCRIPTION OF THE DISCLOSURE

Figure 1:
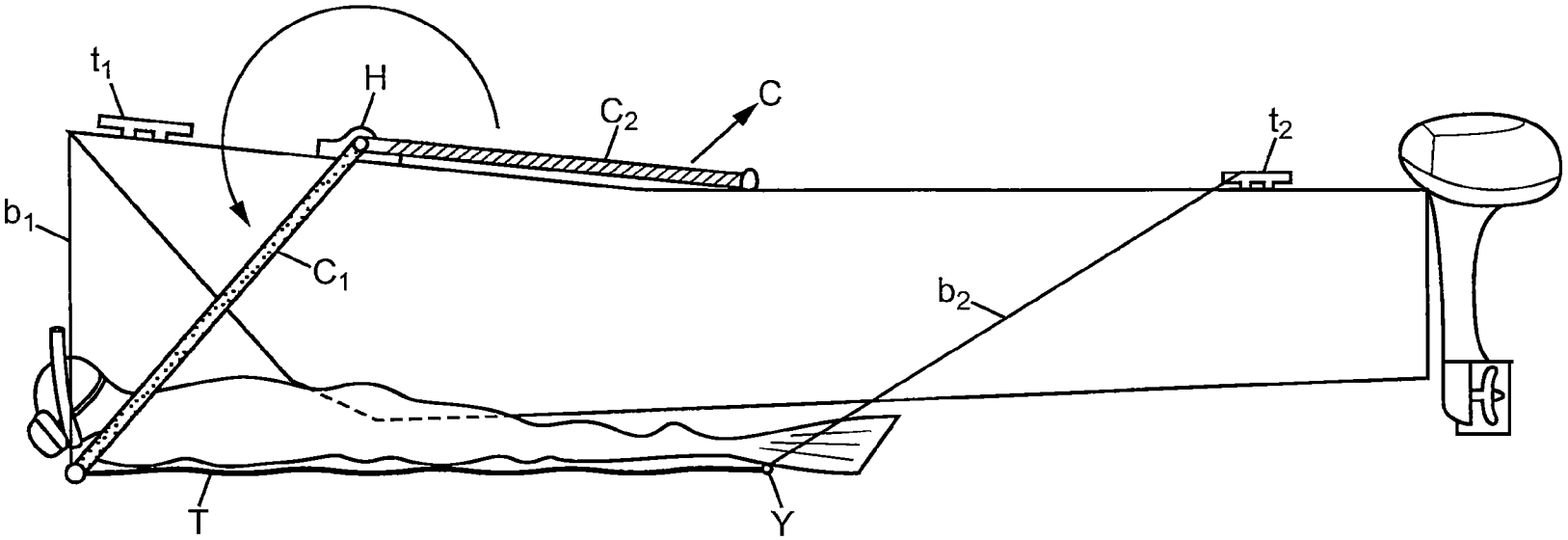
FIG. 1: Side view of a device for exploring the ocean space attached to a monohull vessel, according to an exemplary embodiment, with a support.

In a first embodiment, the invention proposes a device for exploring the ocean space (immediately accessible, for exploring 0 to 30 meters down or more depending on visibility) intended to be attached to a vessel. The vessel is motor-driven for example. The propellers of the vessel must be equipped with propeller protection and an emergency stop control, accessible from the lowered immersed position. This device allows surface immersion of users equipped with simple breathing means (mask and snorkel for snorkeling) to allow visual exploration of the ocean in comfort and autonomy. As a variant, the device allows deeper immersion.

Exploration of the surrounding ocean space is complete and instantly accessible for, among other purposes:

Aquatic or subaquatic exploration;

First outing;

Spearfishing;

Underwater excursion for disabled or elderly users;

Scientific research on aquatic surface flora and fauna;

Monitoring swimming areas (sharks, dangerous currents, etc.)

Scientific observation and sampling;

Filming;

Photography.

The device for exploring the ocean space comprises a support T, deployment means for positioning the support T in a given position under the water, and securing means b1, b2, Y, b, that maintain the support in said given position under the water. The given position under the water is close to the underwater portions of the vessel.

Vessels on which the exploration device can easily be installed are generally small to medium boats with electric motors or combustion engines, equipped with propeller protection and an emergency stop control. It can also be adapted for larger vessels.

Such vessels travel to the exploration sites by their usual mode of operation, with the exploration device in a position out of the water. At the exploration sites, the user deploys the device for exploring the ocean space.

The exploration device allows obtaining a general view of the ocean space under optimal conditions of user safety and comfort, while respecting the ocean environment. It easily accommodates one or more passengers, making snorkel exploration of the ocean space possible when lying on the support T at the surface of the water, in front of, beneath, between, or at the sides of the submerged portions of the vessel.

The water exploration device is fast and easy to install and uninstall on the vessel. Any appropriate means can be provided for attaching the exploration device in a simple and reversible manner to an existing vessel, in particular by clipping it on. The exploration device comprises a support T and a deployment means C, H that is light, removable, and transportable.

The deployment means C, H therefore allows changing from the no-snorkeling fast cruising configuration of the vessel to which the device is attached, to the deployed configuration of said vessel which allows snorkeling.

The device is intended to be attached to a vessel partially immersed in the water and partially above the water. When said exploration device is mounted on said vessel on the water and when said support T is in said given position under the water $C_1$, said deployment means C, H is partially immersed and partially above water, said support T is at least partially immersed water, and the device is therefore immersed to a depth P in said given position under the water $C_1$, said immersion depth P being determined by the geometric characteristics of the deployment means C, H, said depth P being about the thickness of a human being.

One possible embodiment of the device for exploring ocean space is shown in FIG. 1 in a deployed configuration, in front of and below the underwater portions of a vessel, in an immersed situation.

In this embodiment of the invention, the support T may be for example a trampoline-like tarpaulin structure and the user is positioned on or above the support T. In particular, the support may be an opaque tarpaulin that provides additional safety for the user by preventing potential predators from seeing the user for example.

The submerged horizontal portion of the frame where the support attaches at the front lies in front of the submerged portion of the hull so that the trunk and head of the divers are away from the submerged portion of the hull; the legs can lie along the submerged portion of the hull, which increases safety by preventing the diver from being hit by the hull. The anterior portion of the diver's body is completely clear due to the positioning of the frame that is at the front of the vessel. The diver is close to the vessel but is not fully below it.

The tarpaulin, the submerged hull of the boat, and where appropriate the structure, together define a protective space of small volume, about the size of a user, that the user can slip into, in particular from the front or rear or at the sides.

Figure 2:
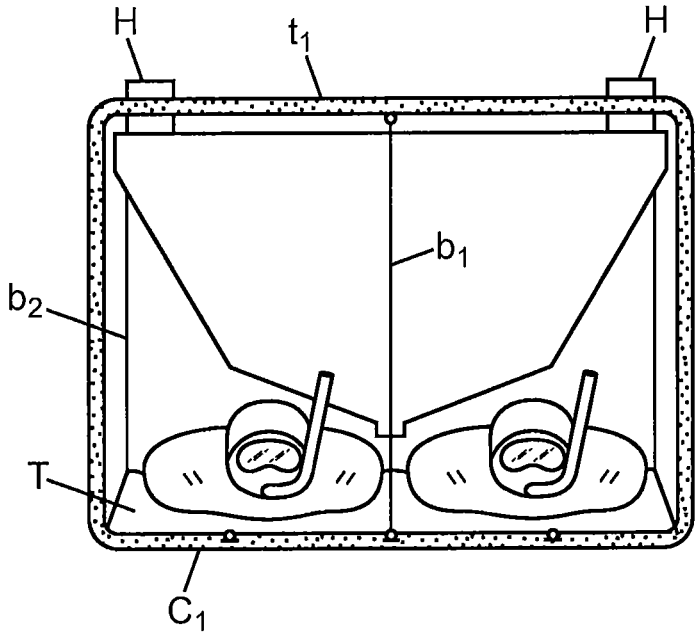
FIG. 2: Front view of the support of FIG. 1 in an immersed position.

In this embodiment, the deployment means C, H advantageously comprises a structure C, represented in FIG. 1 both in the deployed position, meaning the given position under the water $C_1$, and in a position above the water $C_2$, and a guiding system H. This structure C can be implemented using two parallel bars arranged at the port and starboard sides of the vessel or using a frame. The structure C can advantageously be made of composite or metal material. The structure C is preferably designed as a frame whose shape can be rectangular as shown in FIG. 2 or in the form of a U.

The guiding system H of the deployment means may consist, for example, of two bearings H fixed to the port and starboard sides of the vessel, allowing rotational deployment of the exploration device as illustrated in FIG. 1. Advantageously, these bearings H may be made of aluminum coated with Teflon, nylon, or a composite. In another embodiment particularly suitable for vessels with standard inflatable or semi-rigid tubes, the guiding system H can be attached to the vessel by integrated arcuate pads adapting to the shape of the inflatable tubes. In another embodiment, the guiding system H of the deployment means may consist, for example, of hasps or simply ties. The hasps provide flexibility and greater adaptability to any type of vessel, as they no longer require a horizontal plane (the deck of the vessel) to attach to nor being perfectly aligned.

At the front of the vessel, the forward end of the support T is attached between the two bars of the structure C located on the port and starboard sides of the vessel, or preferably, when the exploration device is implemented as the frame version, on the submerged crossbar connecting the two bars. In the frame version, the support T is advantageously attached at the bow to the horizontal portion of the frame by a bolt rope or other simple fastening systems such as sleeve-fitting or lashing (through eyelets on the support T).

In another embodiment, the deployment means C, H moves the support T between a position above the water $C_2$ and the given position under the water $C_1$, the securing means b1, b2, Y, b, maintaining the support T in position $C_1$.

Referring again to FIG. 1, in order to stabilize the support T in the immersed position, the immersed end of the bar or of the structure C can be connected to the vessel by means of one or more ropes $b_1$ which are also connected to the vessel. For example, their end is attached to one or more cleats $t_1$ at the bow of the boat. The rear end Y of the support can be stiffened by a slat on its trailing edge Y and be retained by ropes $b_2$ attached to the rear of the vessel, for example to cleats $t_2$. When the bearing H is equipped with locking means serving as the securing means, the rope $b_1$ is entirely optional. In order to enable the support T to be deployed on either side of the submerged portion of the vessel, the frame C rotates on bearings H attached to the foredeck of the vessel. The locking means of the bearing H allow defining the two positions. They can be optional.

FIG. 2 is a view of the bow of a monohull vessel of FIG. 1, with the exploration device immersed in an embodiment where deployment is under the submerged portion of a vessel as previously described. The deployment means is composed of the guiding system H and the structure C in the frame embodiment, and are stabilized by one or more ropes $b_1$. The guiding system H may be composed of hasps, ties, bearings, and/or clips.

When the support T is deployed under the vessel, the user may be positioned on or above the support T, and preferably is in an advantageous position protected from below by the support and from above by the proximity of the vessel. The user is partially immersed and snorkeling is possible.

Figure 3:
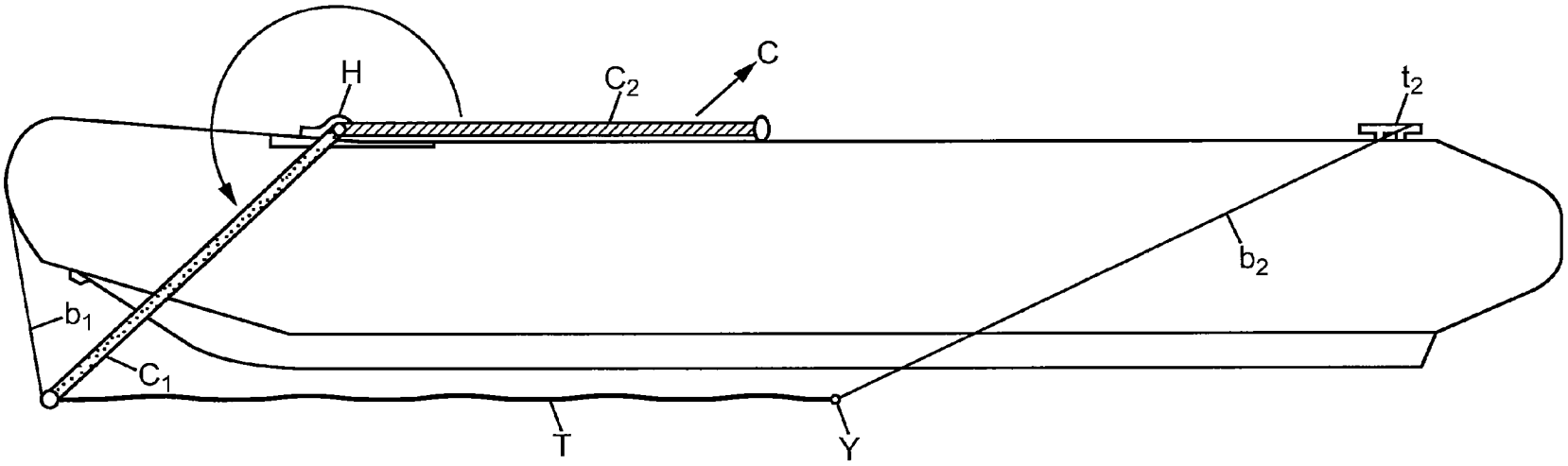
FIG. 3: Side view of a device for exploring the ocean space for an inflatable monohull vessel (may or may not be semi-rigid), according to an exemplary embodiment.

Another embodiment, suitable for flat-bottomed boats such as an inflatable dinghy for example, is shown in FIG. 3. For this type of vessel, the support T is deployed entirely below and in front of the submerged portion of the vessel. When the vessel has inflatable tubes B, the guiding system H is advantageously attached to the vessel with arcuate pads.

In another embodiment, the bars or frames C of the deployment system are adjustable via an adjustable sleeve-coupling system.

In another embodiment, the exploration device is attached to a catamaran with inflatable or composite hulls. In this embodiment, the deployment means C, H of the catamaran are for example the same as for a monohull. However, they are attached for example to the front crossbeam of the catamaran and the rear attachment of the support is achieved using ropes that attach to each hull to cleats at the rear of the vessel. The support T may be attached to its frame by bolt rope, sleeve-coupling, or lashing.

If the device is attached to bearings or hasps, rotation will be possible for its deployment; depending on the initial position of the device above the water, it will rotate from 45 to 270 degrees. It is not deployed vertically but 45 degrees forward. The rotation is assisted and secured by a pulley and cleat system that allows an almost instantaneous conversion from a raised position of the support to an immersed position, as well as the maintaining of the support in a stable immersed position.

Figure 4:
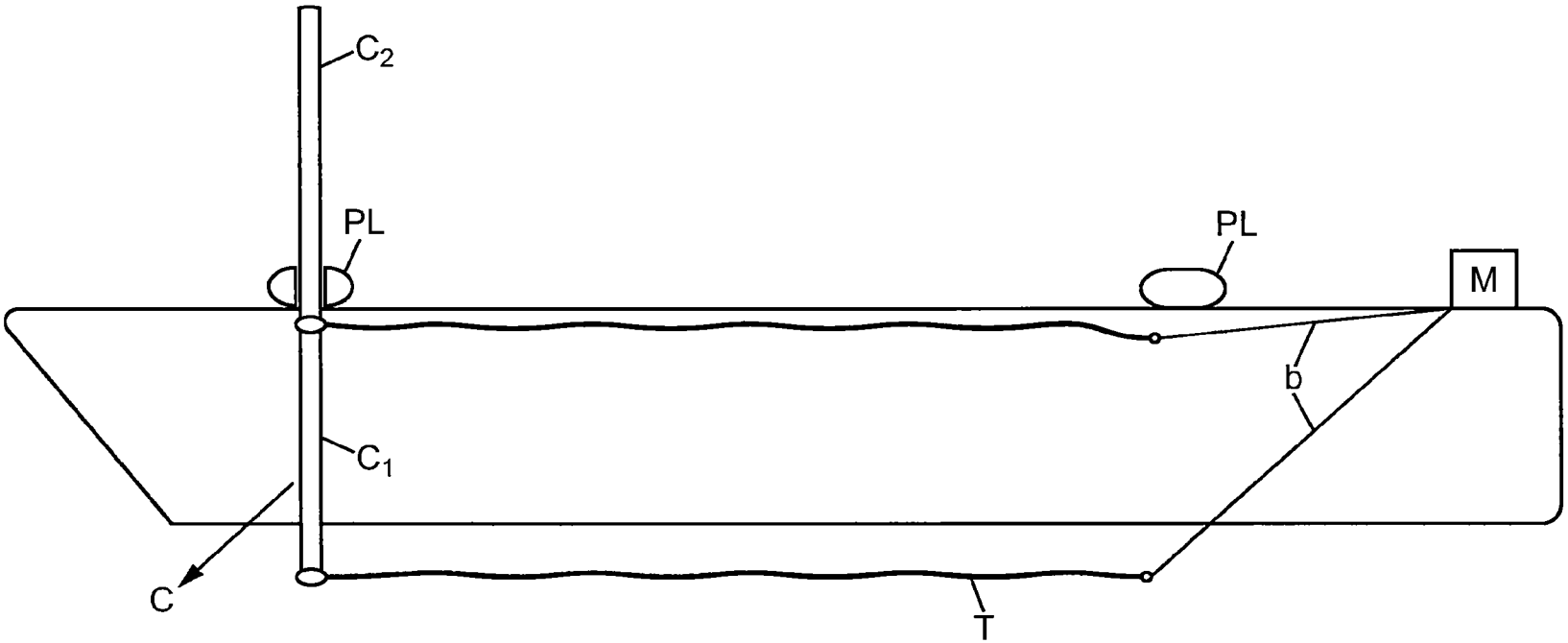
FIG. 4: Side view of the support with a system for vertical translation mounted on a catamaran.

In another embodiment, as shown in FIG. 4, the frame of the trampoline support T can be immersed by a translational movement, for example vertical, of the trampoline frame relative to the vessel, supported by the front structural crossbeam PL. The translational movement is structurally guaranteed down to a given shallow depth. An embodiment with more than two structural crossbeams is also possible.

In another embodiment, the device may be installed between the two floats of a catamaran.

In another embodiment, the device may replace the trampoline of the multihull.

A remote control system may be installed, to allow controlling the vessel from the deployed device in the immersed position. The remote controls for the electric motor or combustion engine M are implemented as rods mounted on gimbals; starting/stopping and acceleration are obtained by rotation, orientation is obtained by pulling and pushing. For safety, an emergency handle may be provided for making emergency stops, as well as protection on the propeller or propellers of the vessel.

Figure 5:
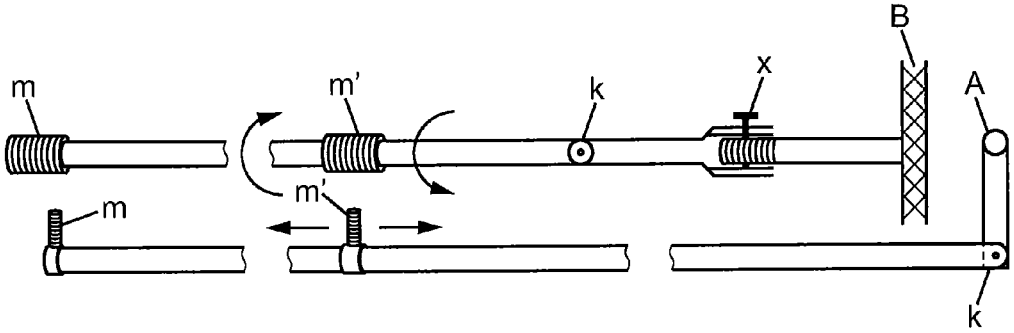
FIG. 5: Diagram illustrating the rigid remote control for vessels.

Such an extension of the control system (FIG. 5) allows a user to continue to control the motorized vessel when in the exploration position, providing the user(s) with complete autonomy. Advantageously, the extension of the control system consists of a direction control A and an acceleration and start/stop control B. In one embodiment, the extension of the control system comprises, among other things, a connection between the throttle and the remote control achieved by attachment via a sleeve-coupling X secured by a screw, a distal handle m, an intermediate handle m', and a gimbal k. Handle m' therefore occupies an intermediate position on the rod. The two handles m and m' enable the diver to control the vessel at multiple levels, for example when lying at the front of the support T by using handle m, or from a sitting position to a more central or even rear position on the vessel by using handle m'.

In another embodiment, electric remote controls (not shown) with flexible cables for two electric motors provide start, stop, and directional control of the vessel.

In another embodiment, the vessel may be equipped with seats, attached to the rear structural crossbeam of a multihull vessel.

The motor M serves to advance the craft. Advantageously, deployment of the ocean exploration device can be done by a motor M if the device is made for large vessels, therefore a much heavier device.

Figure 6:
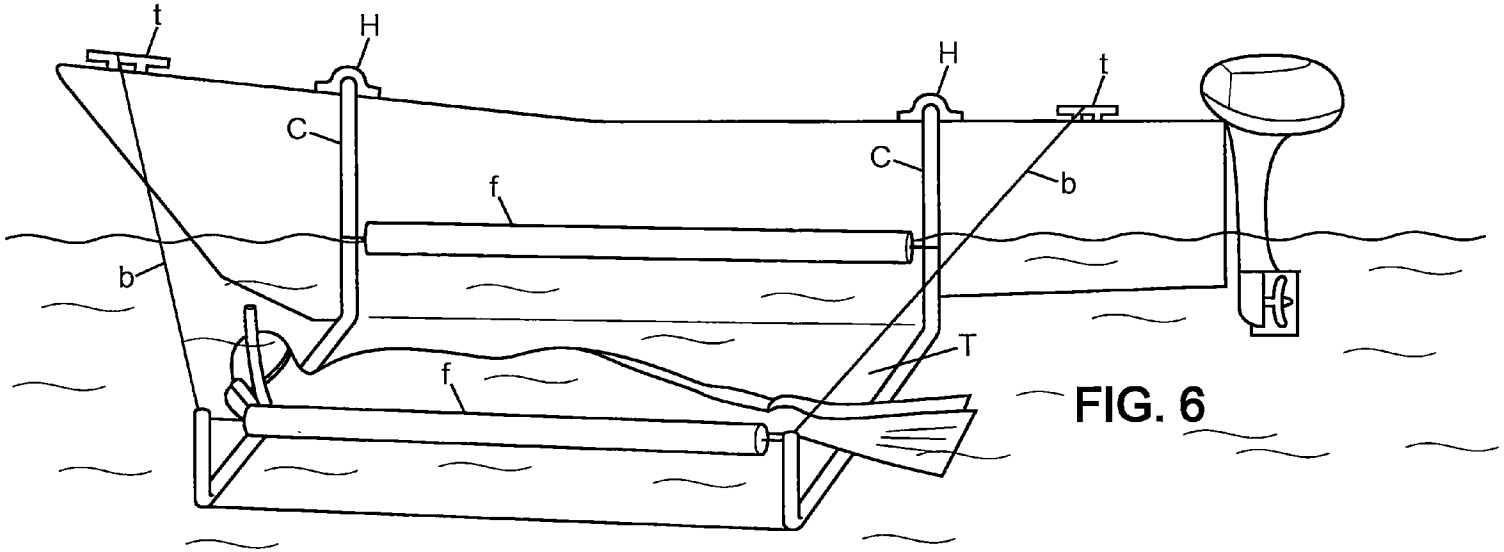
FIG. 6: Side view of a lateral exploration kit attached to a monohull vessel.

In another possible embodiment of the device for exploring the ocean space, represented in FIG. 6, the device is a lateral exploration kit. Deployment occurs on the sides of the submerged portion of a vessel.

Said kit, designed to be attached to a vessel, comprises a support T, a deployment means C, H for positioning the support T in a given position under the water $C_1$, as well as securing means for maintaining the support T in said given position under the water $C_1$. The support T may be, for example, a flexible sheet large enough to accommodate a recumbent occupant, for example a trampoline, a net, or a technical fabric, the support T possibly further comprising one or more stiffening slats.

Figure 7:
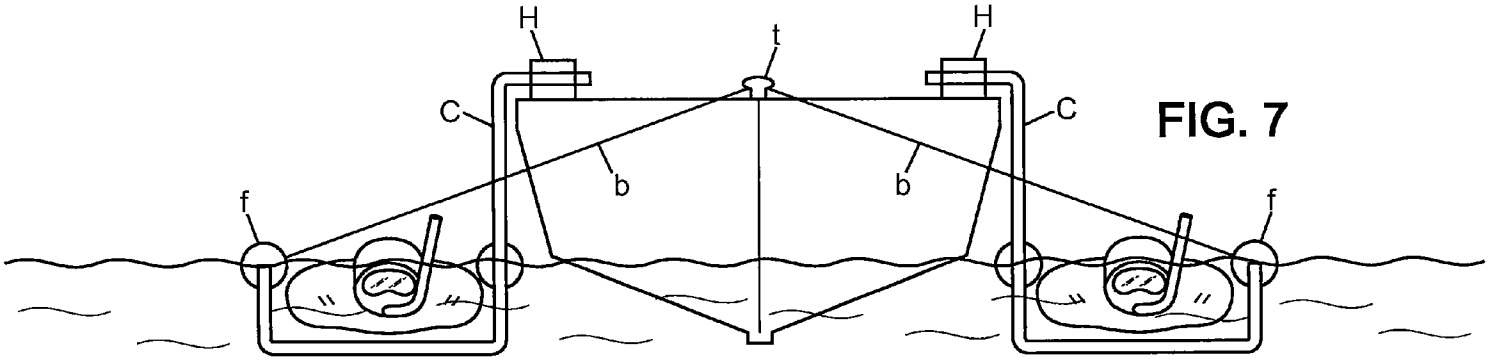
FIG. 7: Front view of two lateral exploration kits attached to a monohull vessel.
Figure 8:
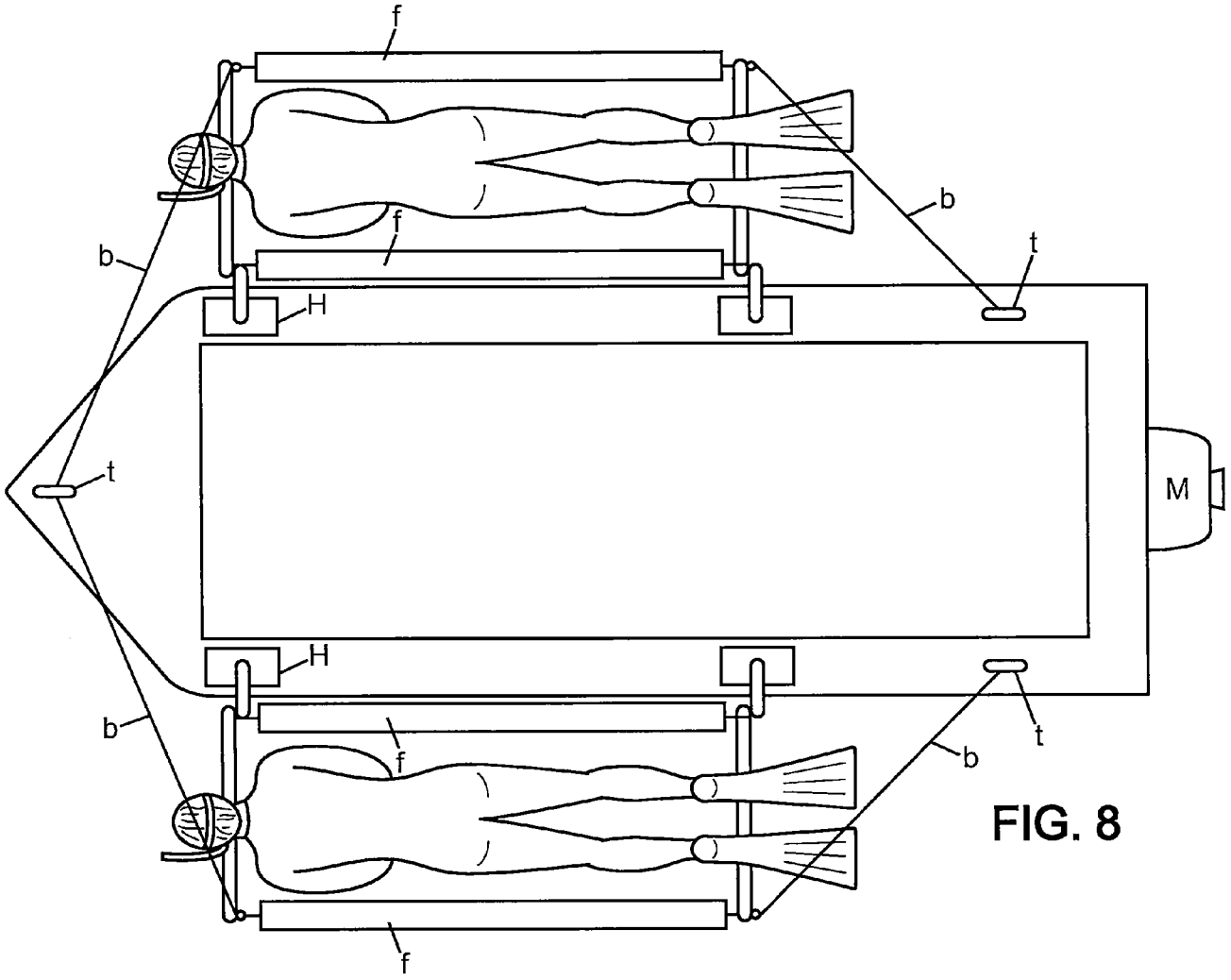
FIG. 8: Top view of two lateral exploration kits attached to a monohull vessel.
Figure 9:
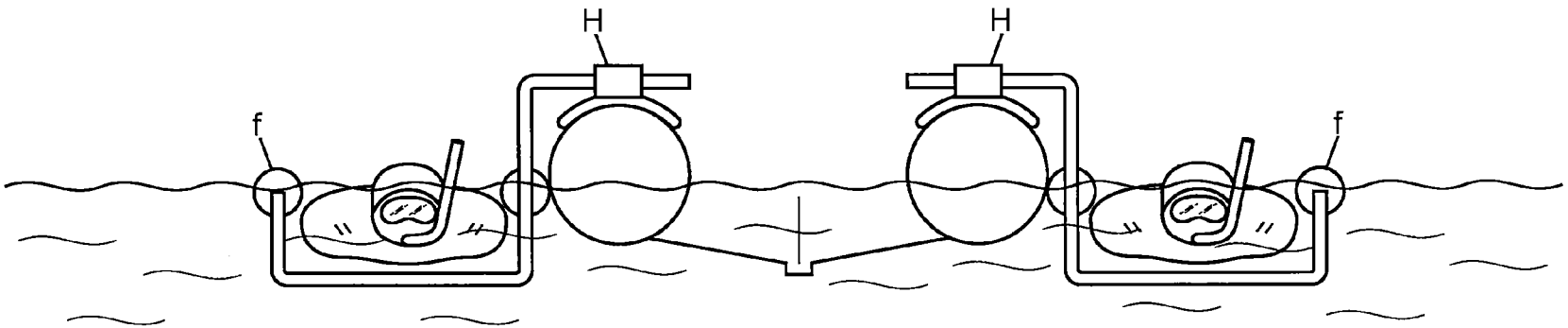
FIG. 9: Front view of two lateral exploration kits attached to an inflatable vessel.

The device is laterally attached to the vessel, which may be a monohull vessel (FIGS. 6, 7, 8) or an inflatable vessel (FIG. 9), unilaterally (FIG. 6) or bilaterally (FIG. 7, 8, 9). It allows a user to lie on the support T and observe the seabed.

As the support T here extends outward from the sides of the vessel, the set of variants for the support T, the guiding system H, and the attachment systems b1, b2, Y, b, of the previous embodiment apply again here. One can also apply the variants of the mode for attaching the support T to the deployment means C, H and the deployment means C, H to the vessel.

The deployment means C, H advantageously comprises two rigid structures C, for example of metal, per lateral face of the vessel, and a guiding system H. On each lateral face, there is a metal structure positioned towards the front of the vessel, and a metal structure positioned towards the rear of the vessel. Each metal structure C comprises for example four sections such that, when the vessel is on water, a first section is parallel to the surface of the vessel and attaches the metal structure to said vessel, a second section is perpendicular to the third section and is of a length such that the lower end is partially immersed, a third section is parallel to the surface of the water and immersed, and a fourth section is parallel to the second section and is at least partially immersed.

The first section of the metal structure is, for example, connected to the guiding system H of the deployment means C, H, said guiding system H being attached to the vessel.

The structure C can be, for example, folded onto itself. Once exploration is complete, it can be folded and rotated to lie along the vessel so that it does not prevent the vessel from traveling fast. The second section, perpendicular to the third section, and the third section, parallel to the surface of the water and immersed, of the structure C are folded onto one another along an axis perpendicular to the surface of the water, on the lateral face of the vessel, so as to form a folded structure. The folded structure may then be pivoted at the guiding system on the vessel, and move from a vertical position to a horizontal position parallel to the surface of the vessel and along the gunwale of the vessel so that it does not prevent the vessel from traveling fast.

Said metal structures C provide a frame to which the support T is attached. The structures C can be made of aluminum or stainless steel. The support T is the location where the user lies. Two elongate floats f are attached, one on each side of the support T. They retain the user on the support, preventing the user from lateral movement and giving the system greater stability.

Attachment of the metal structure C to the vessel can be achieved in several ways.

For a monohull vessel, the structure C may be retained by a sleeve attached to the topside of the vessel. The structure C may have a perpendicular extension which penetrates the topside of the vessel. In this case, nuts and a pin may be used to secure it, for example. Finally, the structure C may be attached by a bearing H, hasps, or ties (FIGS. 6, 7, 8). Two front and rear bearings H may be permanently installed on the vessel. For inflatable boats (FIG. 9), the bearing H or hasp is attached to an arcuate pad. This pad is placed directly on the inflatable tube of the vessel (FIG. 9).

The support is held in the given position under the water by the securing means b1, b2, Y, b, which may for example be similar to those of the previous embodiment. Advantageously, the front and rear structures C are also attached to the vessel by ropes b to provide the kit with greater stability. The ropes b may be attached to cleats t. In this manner, said frame thus retains the support T in the given position under the water $C_1$.

In another embodiment, the first deployment means C, H moves the support T between a position out of the water $C_2$ and a given position under the water $C_1$, the securing means b1, b2, Y, b, maintaining the support T in its position under the water $C_1$.

Figure 10:
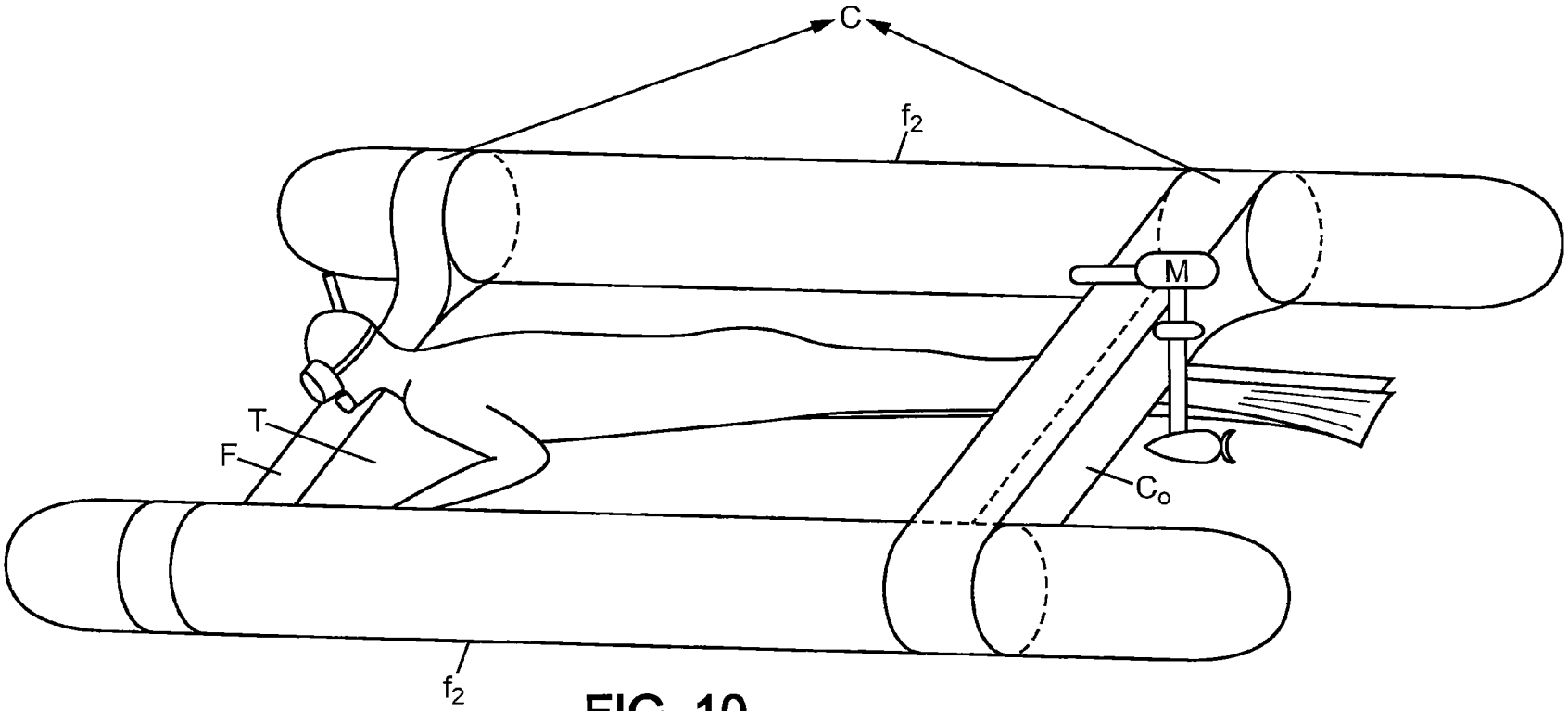
FIG. 10: Top view of a lightweight exploration kit.

In another embodiment, the device is attached to two inflatable floats (FIG. 10). The craft thus formed is lightweight, and quickly assembled and disassembled. If necessary it is foldable. It can easily be transported by car when it is disassembled.

The vessel has two floats f2 which are inflated for example using a manual or electric air pump. In another embodiment, the floats can be composite or rotationally molded.

Said device comprises two structures C: a front structure F and a rear structure Co, said front and rear structures being sufficiently rigid to maintain a constant gap between said two floats of said vessel. Said structures C comprise loops at their ends, said loops being suitable for sliding said floats within them. The loops have sufficient friction against the floats during use to ensure float stability. Other means for attaching the loops to the floats may also be added to ensure stability.

The support T where the user lies also comprises loops on each side, said loops being suitable for sliding said floats within them.

Both front and rear structures C are of composites or aluminum. Structure Co is rigid enough to support the motor. This is also the container for the batteries of an electric motor. Note that structure Co lies higher than the support T, which allows the user to slide his or her fins between structure Co and the support T (FIG. 10).

The front structure C comprises an immersed central portion.

As in the previous embodiments, a remote control system can be implemented for controlling the vessel from a recumbent position, and all the above variants of these modes of control can be applied to this embodiment and the ones below.

In a variant embodiment of the invention, represented by FIGS. 11, 12, 13 and 14, the underwater exploration device attached to a vessel forms a "beluga"-type craft which is a fast craft for surface exploration which can instantly be converted into a craft for exploring the immediate area below the water.

Figure 11:
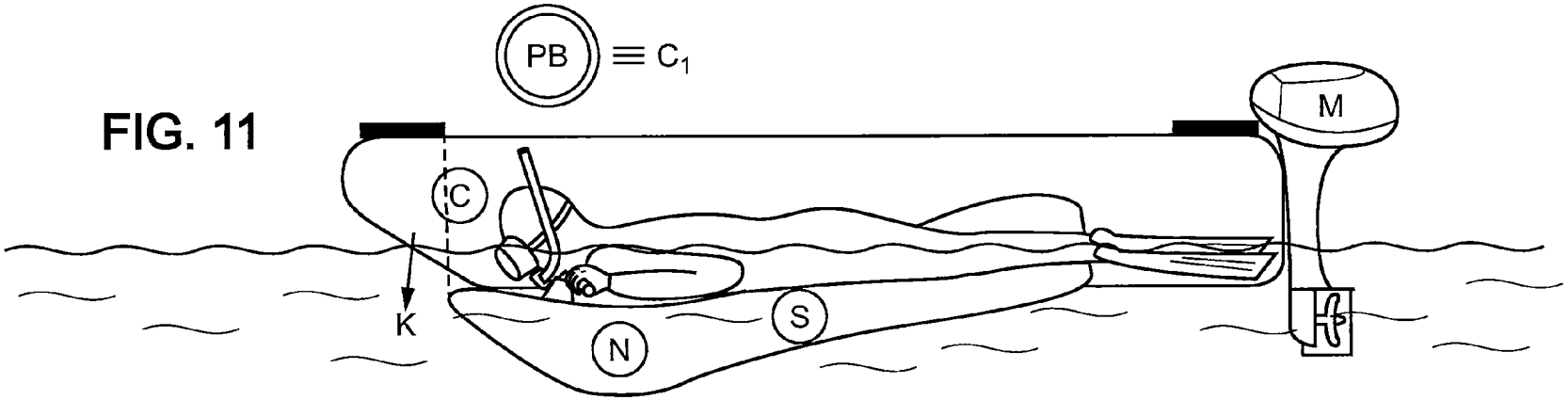
FIG. 11: Side view of a "beluga"-type craft with the cradle in the lowered position.
Figure 12:
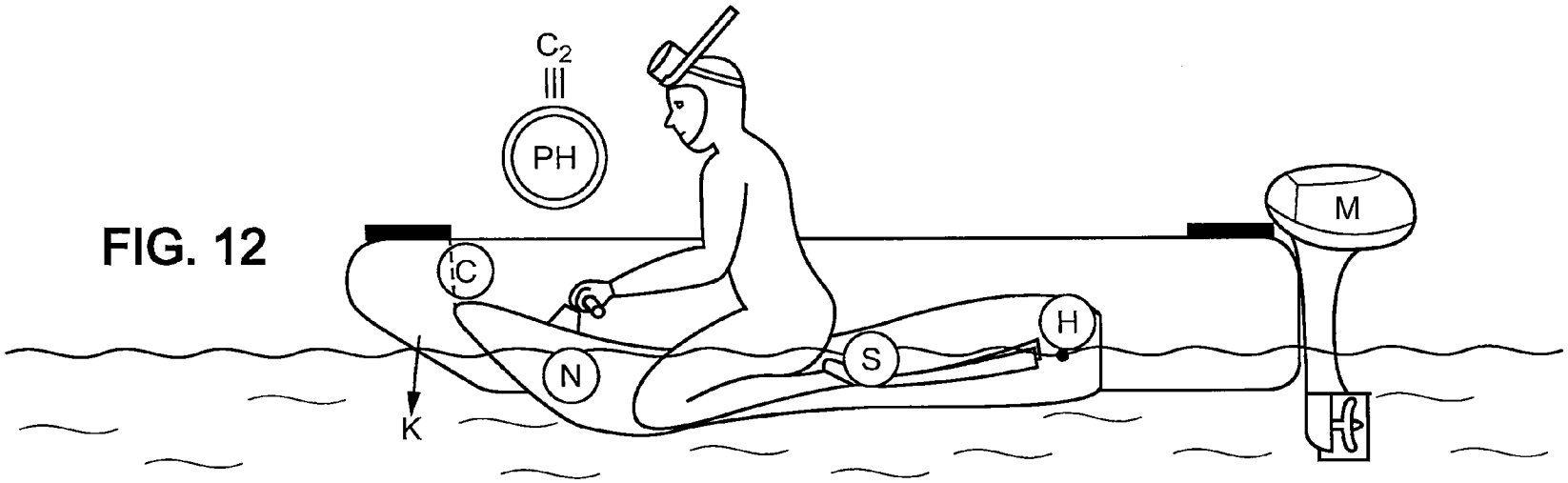
FIG. 12: Side view of the "beluga" craft with the cradle in the raised position.

The device comprises a cradle N attached to a vessel. The cradle N constitutes the support T of said device. Shaft H is a support and rotation shaft transfixing the rear portion of the cradle N. The cradle N pivots about this shaft H. This pivotal movement allows the cradle to move from the raised position PH of the cradle (FIG. 12) to the lowered position PB of the cradle (FIG. 11). In the lowered position PB of the cradle, the front part of the cradle N is sufficiently immersed to place the user in a position for underwater exploration, equipped with only a mask and snorkel. The user is, for example, lying on the cradle N. The user thus has direct and visual access to the underwater area in front of and beneath him or her. In the raised position PH of the cradle N, the user is, for example, sitting on the seat S of the cradle N, and the craft can cruise more quickly to the exploration site.

The lowered position PB therefore corresponds to the given position under the water $C_1$, and the raised position PH corresponds to the given position out of the water $C_2$.

In both positions, raised PH and lowered PB, the user remains in control of the propulsion and steering of the craft. Remote control can be provided by a push-pull system for both the direction and for shifting speeds and accelerating. The controls are the same regardless of the type of use, whether the user is out of the water or immersed at the surface of the water with mask and snorkel. The craft therefore provides complete functionality, allowing the user to move quickly from above the water to immediate underwater observation, by lowering the front part of the cradle N. The cradle N may, for example, be provided with a handlebar D. The handlebar gives the user something to hold on to, as well as for example a means of activating the controls and steering. In the lowered position PB the seat S of the cradle N and the handlebar D are for example submerged.

The craft is powered by either an outboard combustion engine or by an electric motor.

The vessel to which the device is attached comprises hulls K, the hulls K having inner sidewalls and outer sidewalls. The cradle N is, for example, attached between the hulls K of the vessel and therefore pivots on its rear shaft, submerging its front part. The structure of the cradle N is, for example, in contact with the inner sidewalls of the hulls K. The vessel comprises, for example, two hulls K and the cradle N is attached between these two hulls K.

The cradle N attached between the two hulls K is always in contact with the water whether it is in the raised position PH or lowered position PB. When in the raised position PH, together with the two lateral hulls K it forms a gullwing-shaped monohull. The time required to raise and lower the device is therefore reduced by the shortened distance to the water. The position of the person steering is almost instantly changed to a view of the ocean space.

The cradle N contributes to the buoyancy of the vessel comprising the two lateral hulls K.

The hulls K of the vessel and the structure of the cradle N, which is in contact with the inner sidewalls of the hulls K, may be formed for example of composites (polyester, epoxy, glass fiber or carbon or kevlar) or be rotationally molded. The weight of the craft may range from approximately 90 to 120 kilograms excluding the engine or motor, depending on the materials.

Figure 13:
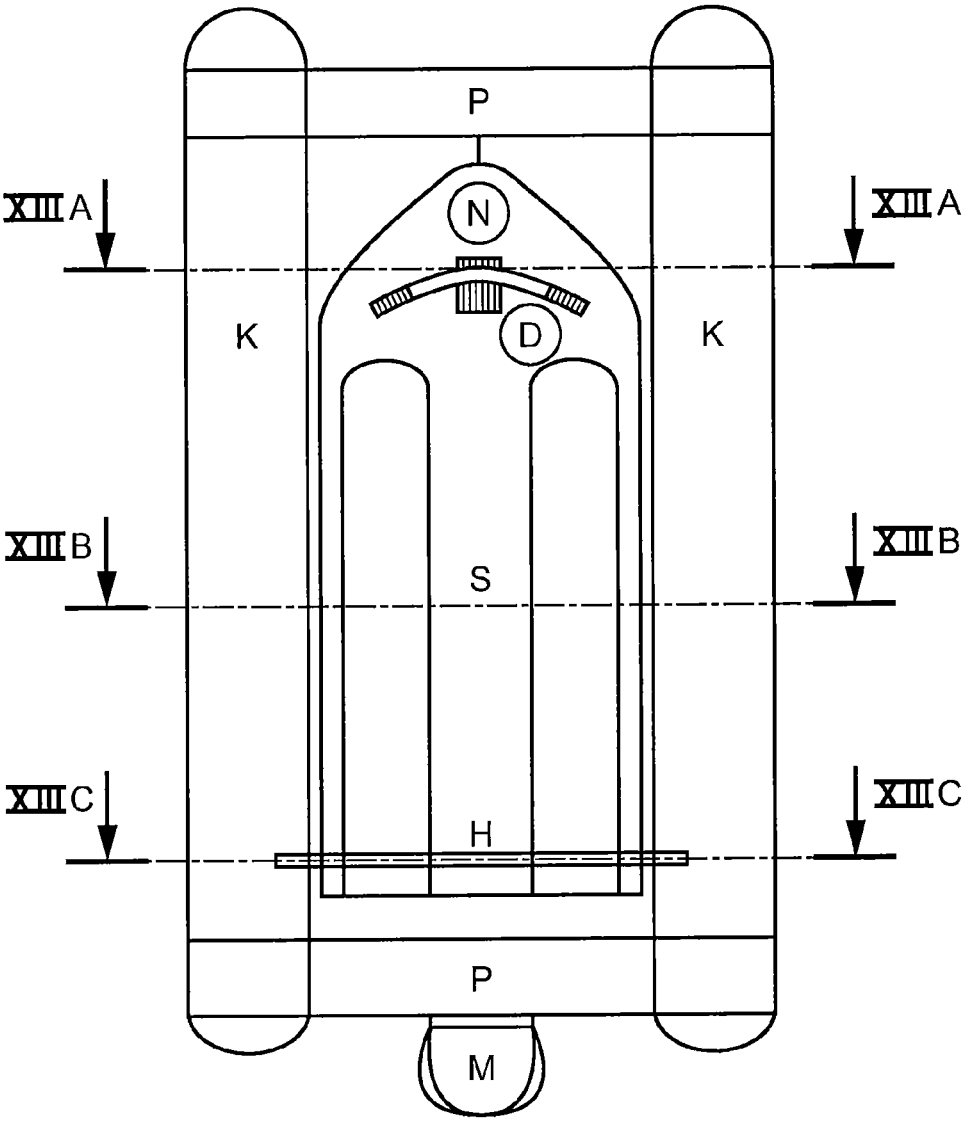
FIG. 13: Top view of the "beluga" craft with the cradle in the lowered position.
Figure 13A:
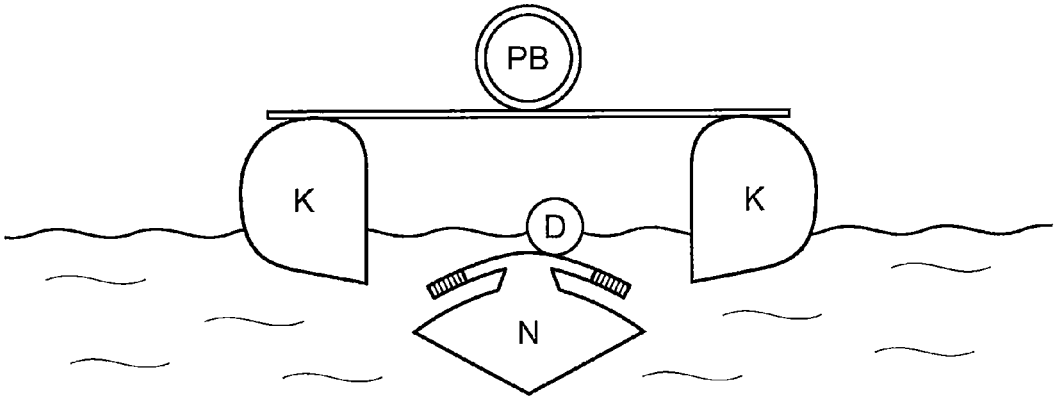
Figure 13B:
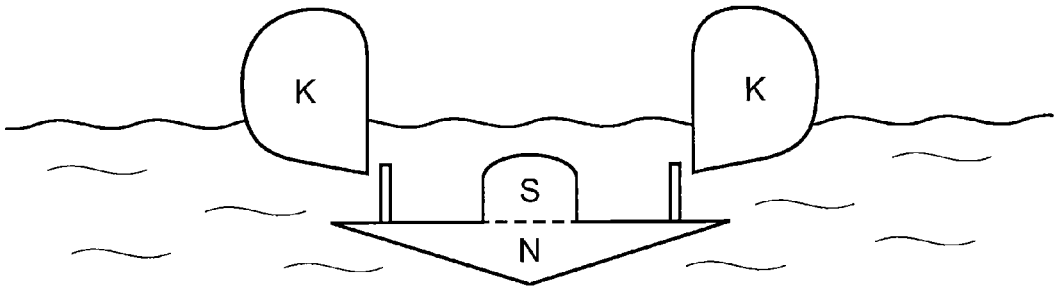
Figure 13C:
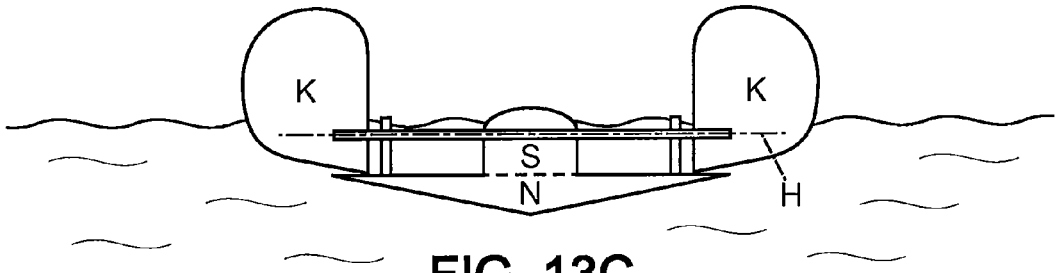
Figure 14:
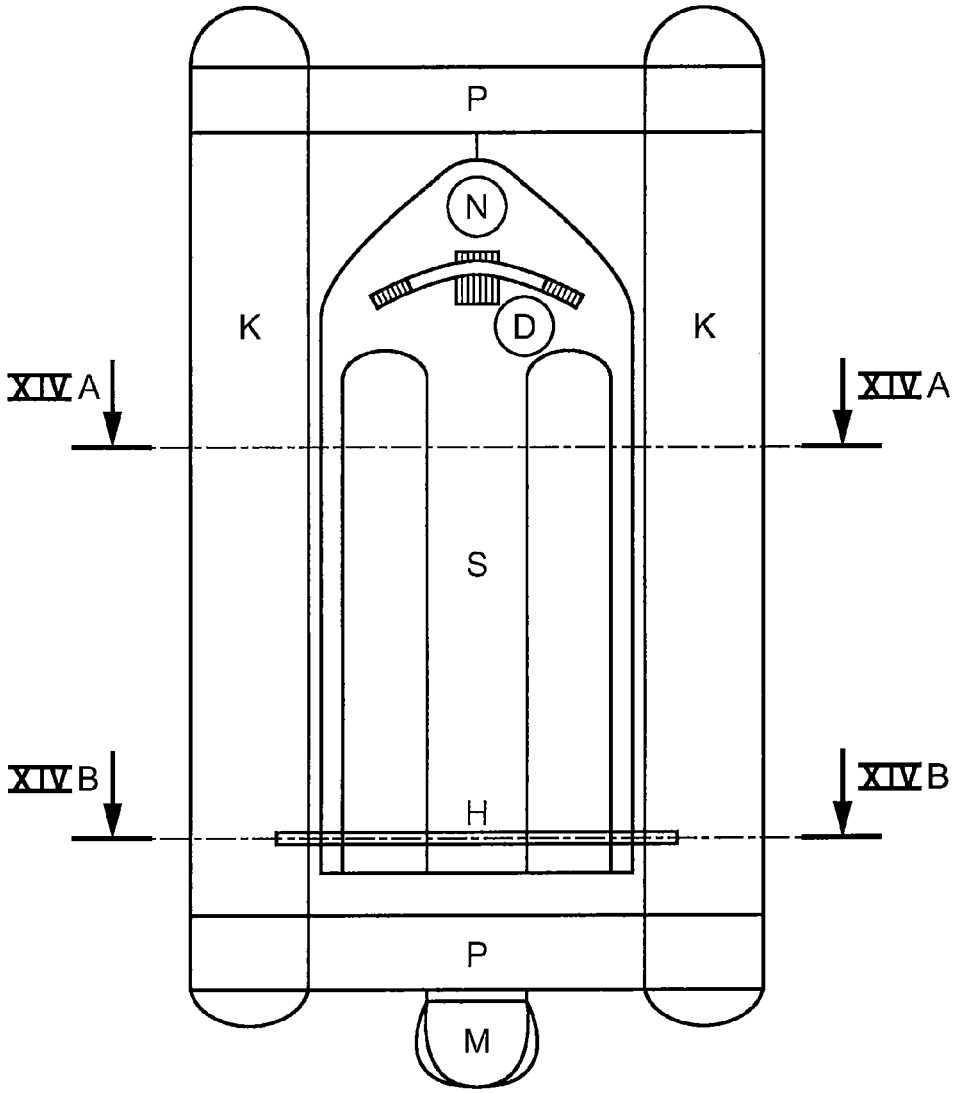
FIG. 14: Top view of the "beluga" craft with the cradle in the raised position.
Figure 14A:
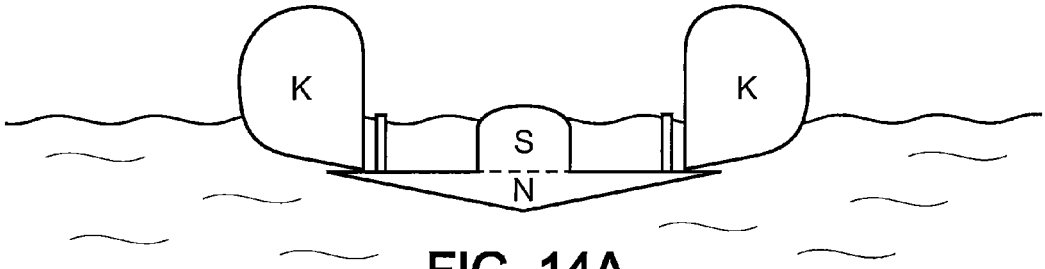
Figure 14B:
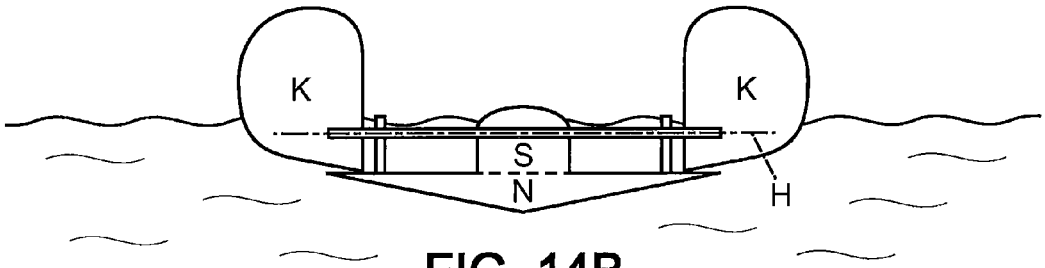

The boat also comprises two structural crossbeams P that connect and retain the hulls K (FIGS. 13 and 14).

Advantageously, the movement mechanism of the cradle N is simple. It is hinged on a transverse shaft H transfixing the rear end of the cradle N. This shaft may be symmetrically attached to the rear portions of the inner sidewalls of the hulls K.

The cradle N is sealingly attached to each hull K via a sealing attachment between the transfixing shaft H and the cradle N, and possibly a sealing attachment between the shaft H and each hull K if the shaft H traverses the structure of each hull K.

There are a plurality of possible technical arrangements, however, to avoid piercing the hulls K and creating possible vulnerabilities in their buoyancy. The shaft H may, for example, be supported by the hulls K, which shifts it upwards to be supported by the gunwale of the hulls K. In this case, the rear shape of the cradle N is adapted to this solution, and may for example be raised to accommodate the higher attachment of the shaft. It is also possible to attach the shaft transfixing the cradle N to the hulls K with plates that are parallel to the inner sidewalls of the hull K, said plates being attached to the gunwale of the hulls K. It is also possible, for example, to have a system of clips in the shape of an inverted U, which are attached to the hulls K and to which the shaft would be attached. Other solutions that support the transfixing shaft H in order to avoid piercing the hulls are possible but will not be described here. Thus the front portion of the cradle can swing downward and be submerged by about 40 centimeters, allowing the user to be properly positioned for underwater observation.

The device comprises, in addition to the cradle N, deployment means C, H and securing means b1, b2, Y, b. The front portion of the cradle is supported by a hoist C. Said hoist C provides the connection between the front portion of the cradle and the front crossbeam P connecting the hulls of the craft. The guiding system H is the transfixing shaft in this embodiment. These two elements form the deployment means C, H of the device in this embodiment. Actuating the hoist C will either raise the front portion of the cradle N or allow it to descend under its own weight and stabilize at the chosen depth, which is about 40 centimeters from the surface.

Securing means b1, b2, Y, b for securing the cradle N in the lowered position PB are provided in order to prevent the relative movement of the cradle N with respect to the vessel and thus improve the stability of the craft. The securing means may be implemented for example by a tubular strut attached to the front portion of the cradle and to the structural crossbeam, the attachment being adjustable to allow varying the depth of the cradle N. In this embodiment, the lowered position PB can correspond to the given position under the water $C_1$ and the raised position PH can correspond to the given position above the water $C_2$.

Advantageously, the first deployment means C, H also allows moving the support T between the position out of the water $C_2$ and the given position under the water $C_1$, the securing means b1, b2, Y, b, maintaining the support T in the position out of the water $C_2$.

It is desirable that the weight of the cradle N is neutral, meaning that the cradle N cannot sink nor can it float atop the water. This is achievable for example by adding polystyrene to the structure of the cradle itself. Furthermore, the front portion of the cradle is V-shaped for better wave penetration. It also has flanges on its sides which are an integral part of the cradle and rest against the inner sidewalls of the hulls K. This serves to keep the cradle N more stable in the raised position PH, but also prevents splashing.

The cradle comprises, for example, a seat S.

The craft as described in FIGS. 11, 12, 13, and 14 is provided for one user. However, it is possible to expand the cradle N so that other users can make use of it as well. The craft is therefore intended for one or more users depending on its width.

The device can easily be mounted on the vessel by assembling the shaft thereto, on each side, and then connecting the front portion of the cradle N to the hoist C.

The invention claimed is:

1. A device for exploring the ocean space, intended to be attached to a vessel, said exploration device comprising: a support able to receive one or more users in a recumbent position; deployment means, said deployment means enabling the positioning of the support in a given position under the water, such that when the support is in said given position under the water said one or more users can lie on the support while being partially immersed; and securing means for maintaining the support in the given position under the water; wherein the deployment means comprises a guiding system, said guiding system being formed of at least two bearings, or two hasps, intended to be arranged respectively on the port and starboard sides of the vessel to allow deployment by rotating bars into the given position under the water.

2. The device according to claim 1 intended to be attached to a vessel partially submerged in water and partially above the water, wherein when said exploration device is mounted on said vessel on the water and when said support is in said given position under the water, said deployment means is partially immersed and partially above water, said support is at least partially immersed, and wherein the device is therefore immersed to a depth in said given position under the water, said immersion depth being determined by the geometric characteristics of the deployment means, said depth being about the thickness of a human body.

3. The device according to claim 1, wherein the deployment means allows moving the support between a position out of the water and the given position under the water.

4. The device according to claim 3, wherein the securing means allow maintaining the support in the given position out of the water.

5. The device according to claim 1, wherein the deployment means is suitable for mounting on the port side and starboard side of the vessel.

6. The device according to claim 1, wherein said deployment means is suitable for mounting at the bow of the vessel.

7. The device according claim 1, wherein said deployment means comprises at least two bars, said bars being intended to be arranged respectively on the port and starboard sides of the vessel and to maintain the support in the given position.

8. The device according to claim 7, wherein the bars of the deployment means are connected by two crossbars to form a closed frame.

9. The device according to claim 7, wherein the bars of the deployment means are connected by one crossbar to form a U-shaped frame.

10. The device according to claim 1, wherein the support in the given position is intended to be arranged under, in front of, or between the submerged portions of the vessel.

11. A device for exploring the ocean space, intended to be attached to a vessel, said exploration device comprising:

a support able to receive one or more users in a recumbent position;

deployment means, said deployment means enabling the positioning of the support in a given position under the water, such that when the support is in said given position under the water said one or more users can lie on the support while being partially immersed; and securing means for maintaining the support in the given position under the water;

wherein the deployment means is intended to be mounted at least either to port or starboard on the lateral faces of the vessel and comprises at least two structures located on the same lateral face of the vessel respectively at the front and back of the boat, said structures forming a frame to which the support is secured in the given position under the water.

12. The device according to claim 11, wherein each structure comprises four sections such that, when the vessel is on water, a first section is parallel to the surface of the vessel and attaches the structure to said vessel, a second section is perpendicular to the third section and is of a length such that the lower end is partially immersed, a third section is parallel to the surface of the water and immersed and is connected to the support, and a fourth section is parallel to the second section and is at least partially immersed.

13. The device according to claim 11, wherein the support comprises at least one elongated float attached between the second sections of the structures and comprises at least one elongated float attached between the fourth sections of the structures.

14. The device according to claim 11, wherein the structure can be folded onto itself, wherein the deployment means comprises a guiding system, said structure being pivoted at the guiding system then raised to a position alongside and parallel to the lateral face of the vessel at the height of the guiding point of the structure.

15. The device according to claim 1, wherein the securing means are front and rear means and wherein the front securing means secure a front end of the support to the deployment means and the rear securing means stabilize the support in a plane substantially parallel to the surface of the water, when said one or more users is lying on the support, being adapted to connect a rear end of the support located opposite the front end to a portion of the vessel located between the front portion and the stern of the boat.

16. The device according to claim 1, wherein the support comprises a flexible sheet that is sufficiently large to accommodate a recumbent user, the support optionally further comprising one or more stiffening slats.

17. The device according to claim 1, comprising at least two securing means for securing to a vessel, said means being spaced apart by a certain gap, and wherein a dimension of the gap is adjustable.

18. A system comprising a semi-rigid vessel and a device for exploring the ocean space equipping said vessel, said device comprising: a support able to receive one or more users in a recumbent position; deployment means, said deployment means enabling the positioning of the support in a given position under the water, such that when the support is in said given position under the water said one or more users can lie on the support while being partially immersed; and securing means for maintaining the support in the given position under the water; wherein the deployment means comprises a guiding system, said guiding system being formed of at least two bearings, or two hasps, intended to be arranged respectively on the port and starboard sides of the vessel to allow deployment by rotating bars into the given position under the water.

19. A system comprising an inflatable vessel and a device for exploring the ocean space equipping said vessel, said device comprising: a support able to receive one or more users in a recumbent position: deployment means, said deployment means enabling the positioning of the support in a given position under the water, such that when the support is in said given position under the water said one or more users can lie on the support while being partially immersed; and securing means for maintaining the support in the given position under the water; wherein the deployment means comprises a guiding system, said guiding system being formed of at least two bearings, or two hasps, intended to be arranged respectively on the port and starboard sides of the vessel to allow deployment by rotating bars into the given position under the water.

20. A system comprising a monohull vessel and a device for exploring the ocean space equipping said vessel, said device comprising: a support able to receive one or more users in a recumbent position; deployment means, said deployment means enabling the positioning of the support in a given position under the water, such that when the support is in said given position under the water said one or more users can lie on the support while being partially immersed; and securing means for maintaining the support in the given position under the water; wherein the deployment means comprises a guiding system, said guiding system being formed of at least two bearings, or two hasps, intended to be arranged respectively on the port and starboard sides of the vessel to allow deployment by rotating bars into the given position under the water.

21. A system comprising a catamaran and a device for exploring the ocean space equipping said catamaran, said device comprising: a support able to receive one or more users in a recumbent position; deployment means, said deployment means enabling the positioning of the support in a given position under the water, such that when the support is in said given position under the water said one or more users can lie on the support while being partially immersed; and securing means for maintaining the support in the given position under the water; wherein the deployment means comprises a guiding system, said guiding system being formed of at least two bearings, or two hasps, intended to be arranged respectively on the port and starboard sides of the vessel to allow deployment by rotating bars into the given position under the water.

22. A device for exploring the ocean space, intended to be attached to a vessel, said exploration device comprising:

a support able to receive one or more users in a recumbent position;

deployment means, said deployment means enabling the positioning of the support in a given position under the water, such that when the support is in said given position under the water said one or more users can lie on the support while being partially immersed; and securing means for maintaining the support in the given position under the water;

wherein the support comprises a cradle, said cradle having a structure, said device being attached to a vessel, said vessel comprising at least one lateral hull, said hull having an inner sidewall facing the cradle structure, and wherein the deployment means of the device is a means for performing a pivoting movement, said cradle pivoting about a shaft, said shaft transfixing the rear end of the cradle, said shaft being sealingly attached to the cradle, said shaft being symmetrically and sealingly attached to the rear portions of the hulls of said vessel, the deployment means comprising a guiding system, said shaft constituting said guiding system.

23. The device according to claim 22, wherein the deployment means is a hoist, said hoist being connected to the center of the front beam, said hoist being adapted to support the front portion of the cradle, actuation of said hoist lowering said front portion of the cradle so as to position the cradle in said given position under the water.

24. The device according to claim 22, wherein the cradle has flanges on its outer sides, which are unmoving relative to the body of the cradle, said flanges being adapted to stabilize the cradle in the given position out of the water.

25. The device according to claim 22, wherein the deployment means allows moving the support between a position out of the water and the given position under the water, the securing means maintaining the support in the given position under the water.

26. The device according to claim 1, further comprising one or more of the following arrangements:

a control means for the vessel which allow remote control of its running a control means for stopping a control means for steering the craft, the control means possibly being gimbal mounted or connected to the vessel by a flexible cable, the vessel is equipped with an emergency stop control its propeller or propellers is/are equipped with propeller protection.

27. A system comprising a vessel comprising a floating body and a device, wherein the device is assembled to the floating body, said device comprising: a support able to receive one or more users in a recumbent position; deployment means, said deployment means enabling the positioning of the support in a given position under the water, such that when the support is in said given position under the water said one or more users can lie on the support while being partially immersed: and securing means for maintaining the support in the given position under the water: wherein the deployment means comprises a guiding system, said guiding system being formed of at least two bearings, or two hasps, intended to be arranged respectively on the port and starboard sides of the vessel to allow deployment by rotating bars into the given position under the water.

28. The system according to claim 27, wherein, in the given position under the water, the floating body and the support define a protective space.

29. The system according to claim 28, wherein another floating body of the vessel or the deployment means defines an additional boundary of the protective space.

30. A vessel adapted to receive a device wherein the vessel is motorized, said device comprising: a support able to receive one or more users in a recumbent position: deployment means, said deployment means enabling the positioning of the support in a given position under the water, such that when the support is in said given position under the water said one or more users can lie on the support while being partially immersed: and securing means for maintaining the support in the given position under the water: wherein the deployment means comprises a guiding system, said guiding system being formed of at least two bearings, or two hasps, intended to be arranged respectively on the port and starboard sides of the vessel to allow deployment by rotating bars into the given position under the water.

* * * * *